US007140454B2

(12) United States Patent
Runia

(10) Patent No.: US 7,140,454 B2
(45) Date of Patent: Nov. 28, 2006

(54) WELL DRILLING BIT

(75) Inventor: Douwe Johannes Runia, Rijswijk (NL)

(73) Assignee: Shell Oil Company, Houston, TX (US)

( * ) Notice: Subject to any disclaimer, the term of this patent is extended or adjusted under 35 U.S.C. 154(b) by 169 days.

(21) Appl. No.: 10/482,890

(22) PCT Filed: Jul. 5, 2002

(86) PCT No.: PCT/EP02/07533

§ 371 (c)(1),
(2), (4) Date: Jun. 24, 2004

(87) PCT Pub. No.: WO03/004825

PCT Pub. Date: Jan. 16, 2003

(65) Prior Publication Data

US 2004/0238224 A1 Dec. 2, 2004

(30) Foreign Application Priority Data

Jul. 6, 2001 (EP) ..... 01305877

(51) Int. Cl.
*E21B 10/20* (2006.01)
*E21B 10/26* (2006.01)

(52) U.S. Cl. ..... 175/57; 175/317; 175/339; 175/366

(58) Field of Classification Search ..... 175/317, 175/339, 357, 366, 57
See application file for complete search history.

(56) References Cited

U.S. PATENT DOCUMENTS

| | | | | |
|---|---|---|---|---|
| 2,179,010 A | | 11/1939 | Creighton et al. | 255/72 |
| 2,284,580 A | | 5/1942 | Kammerer | 255/61 |
| 2,782,005 A | | 2/1957 | Appleton | 255/340 |
| 3,052,838 A | | 9/1962 | Bennett et al. | 324/10 |
| 3,112,442 A | | 11/1963 | Bennett | 324/1 |
| 3,117,636 A | | 1/1964 | Wilcox et al. | 175/275 |
| 3,216,514 A | * | 11/1965 | Nelson | 175/238 |
| 3,409,081 A | | 11/1968 | Brown | 166/35 |
| 3,429,387 A | | 2/1969 | Brown | |
| 3,700,049 A | | 10/1972 | Tirapolsky et al. | |
| 3,789,936 A | | 2/1974 | McCullough | |
| 4,096,917 A | * | 6/1978 | Harris | 175/228 |
| 4,421,184 A | * | 12/1983 | Mullins | 175/337 |
| 4,932,005 A | | 6/1990 | Birdwell | 367/83 |
| 5,244,050 A | | 9/1993 | Estes | |
| 5,589,825 A | | 12/1996 | Pomerleau | |
| 6,269,891 B1 | | 8/2001 | Runia | |

FOREIGN PATENT DOCUMENTS

| | | |
|---|---|---|
| GB | 2.146.126 A | 11/1985 |
| GB | 2345502 | 7/2000 |
| WO | 99/08827 | 2/1999 |
| WO | 00/17488 | 3/2000 |

* cited by examiner

*Primary Examiner*—Jennifer H. Gay
*Assistant Examiner*—Shane Bomar

(57) ABSTRACT

A well drilling bit having a bit body attachable to a tubular drill string, which bit body is internally provided with a passageway providing fluid communication, when the drill string is attached to the bit body, between the interior of the drill string and the exterior of the bit body; a closure element for selectively closing the passageway; and one or more chip-making elements, wherein the chip-making elements has one or more roller-cones, wherein the closure element is releasably connectable to the bit body, and outwardly movable from a closing position to an opening position, and wherein the closure element includes at least one of the roller-cones.

21 Claims, 4 Drawing Sheets

WELL DRILLING BIT

PRIORITY CLAIM

The present application claims priority on European Patent Application 01305877.1 filed on 6 Jul. 2001.

FIELD OF THE INVENTION

The present invention relates to a well drilling bit for drilling a wellbore into an underground formation. The invention is in particular related to a well drilling bit comprising at least one roller cone, which bit is provided with a passageway for providing fluid communication between the interior of an attached drill string and the exterior of the well drilling bit.

BACKGROUND OF THE INVENTION

Well drilling bits provided with such a passageway are particularly useful for performing operations in the wellbore ahead of the drilling bit quickly after drilling operation has stopped, without the need to first retrieve the drilling bit to the surface. Such operations can for example include formation testing (logging), or drilling of a pilot hole of smaller size.

U.S. Pat. No. 5,244,050 discloses a well drilling bit comprising a bit body provided at its face with one or more fixedly attached roller cones. The bit body is attachable to a tubular drill string, and is internally provided with a passageway providing fluid communication between the interior of the attached drill string and the exterior of the bit body. The passageway opens towards the exterior of the bit body through a port in the face of the bit body, which port is arranged in a region where no roller cone is attached. The bit body comprises a hinged closure means for selectively closing the port. When the port is open, a tool such as a logging tool or a pilot drill string can be passed from inside the drill string through the passageway into the well exterior of the well drilling bit. In conventional roller-cone bits without a passageway, the roller cones cover virtually all the face of the bit body, and shape and relative arrangement of the cones and the cutters on the cones are designed for optimum drilling performance. A well-known roller-cone bit that is widely used in the art is known as the tricone bit wherein three substantially equal cones carrying teeth or cutters are arranged symmetrically on the bit face. The size and geometry of the cones, the arrangement of the teeth or cutters on the cones, the precise alignment, bearing and materials used are optimised in conventional roller cone bits depending on the particular application.

In contrast, in comparison with conventional roller-cone bits, at least one of the roller cones has to be left out in the well drilling bit according to the USA patent, in order to allow sufficient space for a port. This well drilling bit therefore has the disadvantage that in order to provide the passageway the drilling performance is decreased in comparison with that of a conventional roller-cone bit.

SUMMARY OF THE INVENTION

It is an object of the present invention to provide a well drilling bit comprising at least one roller-cone chip-making element and provided with a passageway that provides easy access to the wellbore ahead of the drilling bit during normal operation, wherein the drilling performance does not have to be compromised by the space required for the port of the passageway.

To this end there is provided a well drilling bit comprising:

- a bit body attachable to a tubular drill string, which bit body is internally provided with a passageway other than a nozzle, which passageway provides fluid communication, when the drill string is attached to the bit body, between the interior of the drill string and the exterior of the bit body;
- a closure element for selectively closing the passageway; and
- one or more chip-making elements, wherein the chip-making elements comprise one or more roller-cones, wherein the closure element is releasably connectable to the bit body, and outwardly movable from a closing position, in which the closure element is connected to the bit body, to an opening position, in which the closure element is disconnected from the bit body, wherein the closure element includes at least one of the roller-cones, and wherein the passageway comprises a section that is not co-axial with the central longitudinal axis.

The term chip-making element is used in the specification and in the claims to refer to any element on a drilling bit for mechanical disintegration of the rock, for example polycrystalline diamond cutters, or roller cones.

The present invention is based on the insight, that the space of the port can be utilized for drilling operation, by providing the closure element with at least one roller cone, and by arranging the closure element so that it can be removed from the bit body outwardly, i.e. in the direction of the wellbore ahead of the well drilling bit, opposite to the side of the drill string which is connected to the well drilling bit during normal operation. This arrangement allows the roller cone on the closure element to be designed such that it optimally cooperates with chip-making elements on the bit body for optimum drilling performance. At the same time, it allows easy removal of the closure element from the closing position so as to gain immediate access to the wellbore ahead of the drill bit through the passageway. Using the present invention it is for example possible to construct a drilling bit with a passageway, which bit has the same overall shape, in particular the same arrangement of cones and teeth/cutters on the cones, as a conventional roller-cone drilling bit, e.g. a tricone bit.

International Patent Application with publication number WO00/17488 hereby incorporated by reference discloses a system for drilling and logging of a wellbore. The system comprises a drill string having an axial channel, a removable closure element at the lower end of the channel, and a logging tool string. The logging tool string is arranged so that it can connect from inside the drill string to the closure element. When the closure element is removed, the logging tool string can pass to the exterior of the drill string.

U.S. Pat. No. 3,117,636 hereby incorporated by reference discloses a roller-cone casing bit having a removable center bit section which can be retrieved through the casing to the surface, so as to allow a coring or conventional drill bit to be operated through an axial passageway in the casing bit.

U.S. Pat. No. 2,782,005,636 hereby incorporated by reference discloses a tricone roller-cone bit, wherein each roller cone is connected to the bit body by first and second connection means, so that each roller cone is movable from a drilling position to a release position. The first connection means provides fixed connection of the roller cone in the drilling position for normal drilling operation, and comprises a frangible element, which can be broken in case the roller-cone bit gets locked in the wellbore. The second connection means is flexible so as to allow, after the frangible element was broken, limited movement of the roller cone to a release position, thereby allowing withdrawal of the roller-cone bit from the wellbore.

BRIEF DESCRIPTION OF THE DRAWINGS

The present invention will now be described by way of example with reference to the accompanying drawings, wherein.

DETAILED DESCRIPTION OF THE PREFERRED EMBODIMENT

Figure 1:
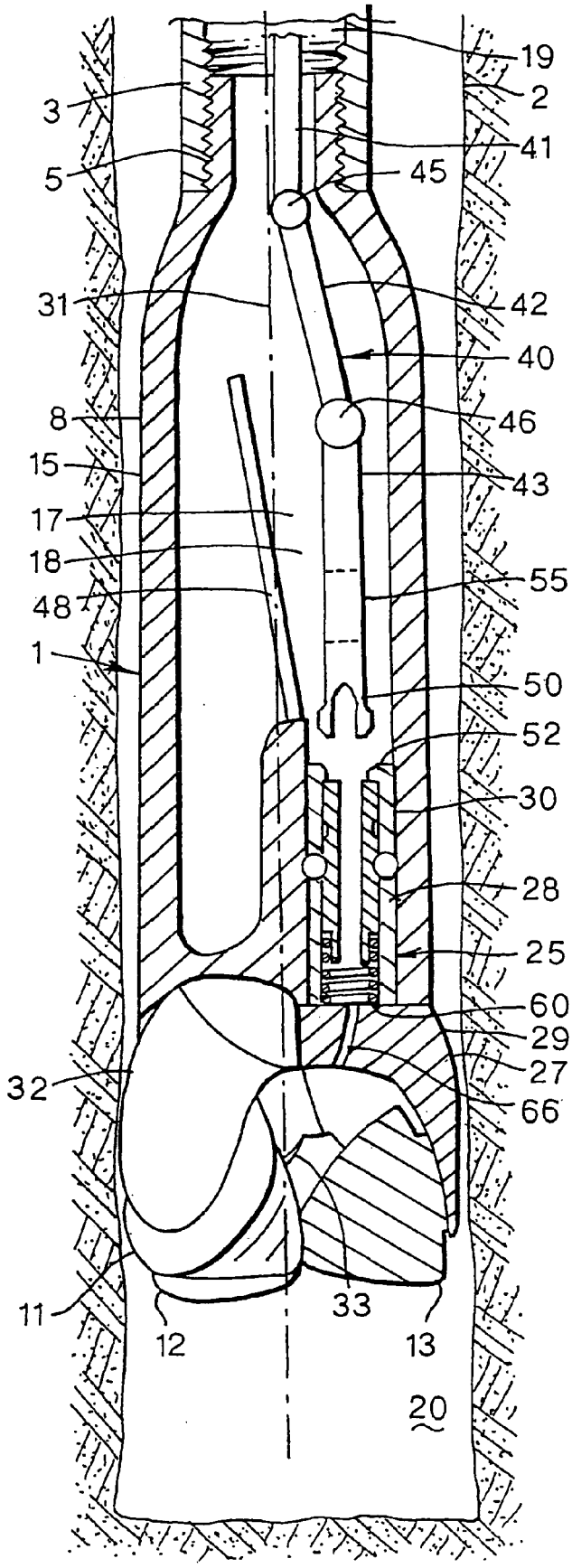
FIG. 1 shows schematically a first embodiment of a drilling bit according to the invention.

Reference is made to FIG. 1, which Figure schematically shows a longitudinal cross-section of a well drilling bit 1 in a wellbore 2. The rotary drilling bit 1 is attached to a drill string 3 via threading 5 at the upper end of the bit body 8, and is provided with three chip-making elements in the form of roller cones, 11, 12, 13 at the opposite end, which are generally arranged as in a conventional tricone bit. Note, that the roller cones 11 and 12 are shown perspectively, whereas roller cone 13 is shown in cross-section, and that the individual cutting teeth or inserts of the roller cones are not shown.

The bit body 8 has an elongated bit shank 15. The interior 17 of the bit body 8 (bit shank 15) forms a passageway 18 providing fluid communication between the interior 19 of the drill string 3 and the exterior 20 of the drilling bit 1, as will be pointed out in more detail below.

The drilling bit 1 is further provided with a removable closure element 25, which is shown in its closing position with respect to the passageway in FIG. 1. The closure element of this example includes a roller cone 13, a cone leg 27, and an extended cone shank with internals, generally referred to by reference numeral 28. The cone leg 27 functions as carrier element for the roller cone 13, and includes the necessary bearing and lubrication means (not shown). The extended cone shank 28, which is attached to the base 29 of the cone leg 27, has substantially cylindrical shape and extends into a bore 30 in the bit body 8 with narrow clearance. The bore 30 forms the downstream part of the passageway 18. The bore 30 is arranged parallel and not co-axial with the central longitudinal axis 31 of the drilling bit around which the bit rotates during drilling, thereby forming an opening in the bit body essentially behind the roller cone 13. The cone shank 28, and therewith the closure element 25, is releasably connected to the bit body 8 via a latching mechanism in the bore 30, which will be discussed in more detail with reference to FIG. 3.

The roller cones 11 and 12 are attached to the bit body 8 via fixed carrier elements in the form of cone legs 32 and 33.

There is further provided an auxiliary tool 40 which can extend from the interior 19 of the drill string 3 into the passageway 18. The auxiliary tool has three longitudinal sections 41,42,43, which are hingedly connected via joints 45,46. In the interior 17 of the bit shank 15 there is provided a guiding means in the form of whipstock 48, which serves to guide the auxiliary tool 40 through the passageway 18 so that it can enter the off-axis bore 30.

The auxiliary tool 40 at its lower end is provided with a connection means 50 for connecting to the upper end 52 of the extended cone shank 28. This will be pointed out in more detail with reference to FIG. 3. Further, the auxiliary tool 40 can include a measurement section 55.

The drilling bit 1 can further be provided with nozzles, for example nozzle 66 in the base 29 of the cone leg 27. Through the nozzles a jet of drilling fluid from inside the drill string can be provided, to wash away the cuttings produced by the chip-making elements during drilling operation. It will be understood that even with the closure element in the closing position some fluid communication between interior and exterior of the bit is possible through the nozzle, but that the nozzle is not a passageway. Preferably, the smallest cross-sectional area along the passageway is at least 5 $cm^2$, more preferably the passageway is arranged so as to allow a cylindrical body of about 2.5 cm (1 inch) diameter to pass through the passageway.

Figure 2:
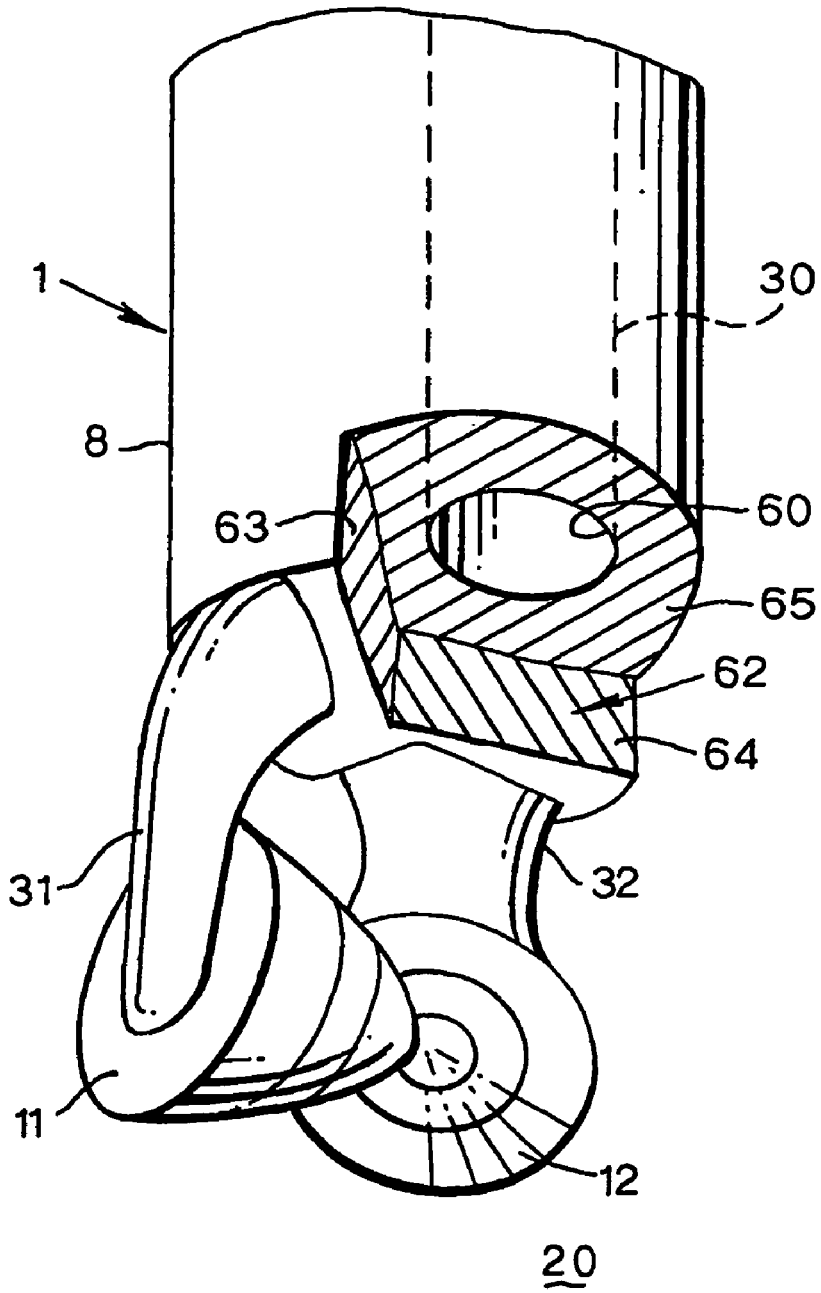
FIG. 2 shows schematically a perspective sketch of the drilling bit of FIG. 1, wherein the closure element has been removed.

Reference is now made to FIG. 2, showing a perspective view of the lower end of the drilling bit 1, wherein the closure element 25 has been removed. The same reference numerals as in FIG. 1 are used to refer to the same objects.

When the closure element 25 is removed from its closing position in the bit body 8, the bore 30 opens into the space 20 exterior of the drilling bit via opening 60, thereby providing access to the exterior of the drilling bit from the interior of the drill string. As can be seen from FIG. 1, opening 60 is in fluid communication with the interior 19 of the drill string 3 via the passageway 18.

The bit body 8 has a recess 62 around the opening 60. The recess 62 has substantially the shape of a disc sector with contact surfaces 63, 64, 65. The base 29 of the cone leg 27 (not shown in FIG. 2) has the shape of a disc sector with contact surfaces that co-operate with the surfaces 63,64,and 65.

The drilling bit 1 shown in FIGS. 1 and 2 can for example be manufactured by modifying a conventional tricone drilling bit. For example, by using a 21.6 cm (8.5") tricone bit, it is possible to arrange a bore 30 with internal diameter 6.3 cm (2.5") in the bit body, through which an auxiliary tool with a maximum diameter of 5.7 cm (2.25") can pass.

Figure 3:
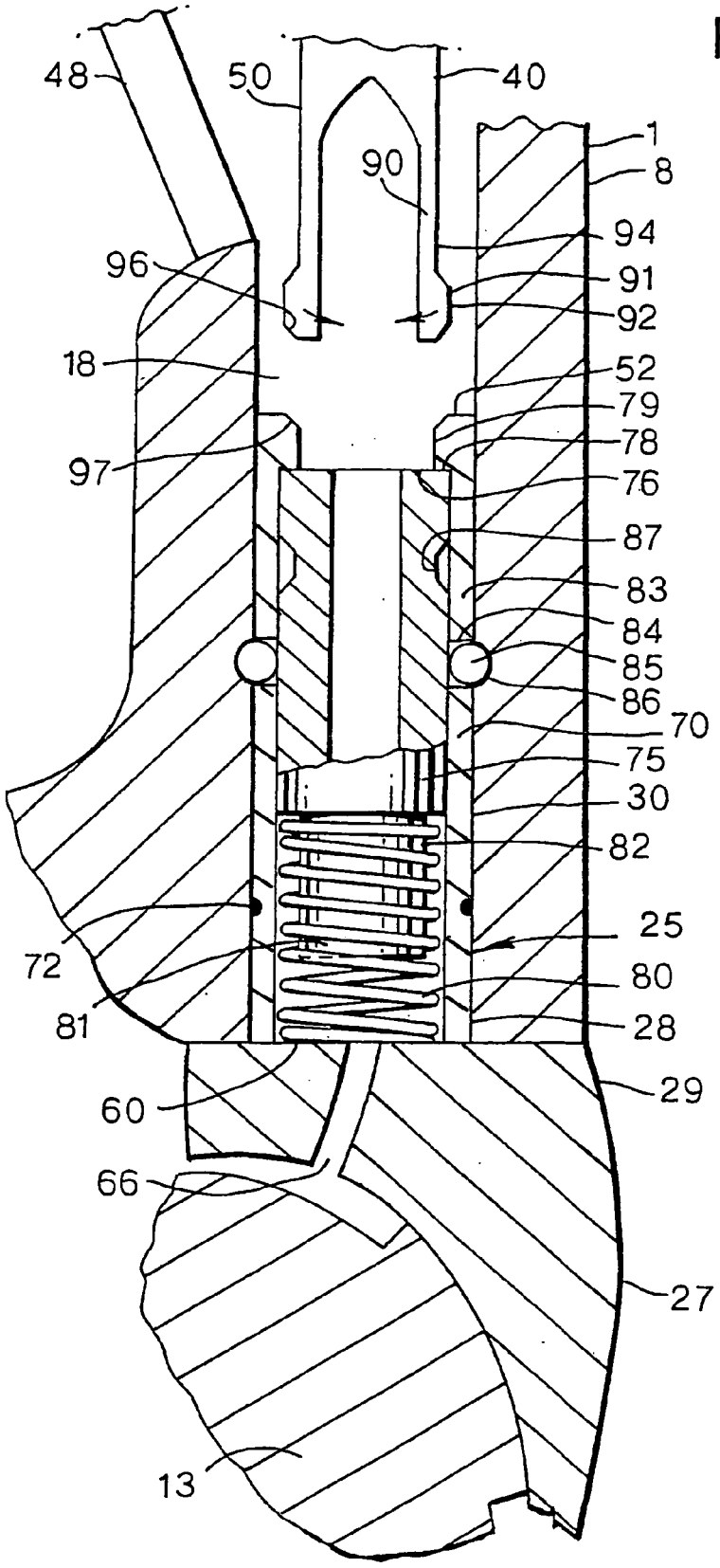
FIG. 3 shows schematically an example of a latching mechanism for the closure element.

Reference is now made to FIG. 3, in order to discuss the latching mechanism of the closure element 25. Like reference numerals are used to refer to the same parts as in FIGS. 1 and 2.

FIG. 3 shows the part of the drilling bit 1 wherein the bore 30 is arranged. The closure element 25 is shown in its closing position, wherein it is connected to the bit body 8 so that it closes the passageway 18. The extended cone shank 28 of the closure element 25 comprises a substantially cylindrical outer sleeve 70 which extends with narrow clearance along the bore 30. A sealing ring 72 is arranged in a groove around the circumference of the outer sleeve 70, to prevent fluid communication along the outer surface of the cone shank 28. Connected to the lower end of the sleeve 70 is the cone leg 27, which carries the cone 13. The cone shank 28 further comprises an inner sleeve 75 which slidingly fits into the outer sleeve 70. The inner sleeve 75 is biased with its upper end 76 against an inward shoulder 78 formed by an inward rim 79 near the upper end of the sleeve 70. The biasing force is exerted by a partly compressed helical spring 80, which pushes the inner sleeve 75 away from the base 29 of the cone leg 27. At its lower end 81 the inner sleeve 75 is provided with an annular recess 82 which is arranged to embrace the upper part of spring 80.

The wall 83 of the outer sleeve 70 is provided with recesses 84 wherein locking balls 85 are arranged. A locking ball 85 has a larger diameter than the thickness of the wall 83, and the recess 84 is arranged to hold the ball 85 loosely so that it can move a limited distance radially in and out of the sleeve 70. Two locking balls 85 are shown in the drawing, however it will be clear that more locking balls can be arranged.

In the closing position as shown in FIG. 3 the locking balls 85 are pushed radially outwardly by the inner sleeve 75, and register with the annular recess 86 arranged in the bit body 8 around the bore 30. In this way the closure element 25 is locked to the drilling bit 1. The inner sleeve 75 is further provided with an annular recess 87, which is, in the closing position, longitudinally displaced with respect to the recess 86 in the direction of the drill string 3.

The inward rim 79 is arranged to cooperate with the connection means 50 at the lower end of the auxiliary tool 40. The connection means 50 is provided with a number of legs 90 extending longitudinally downwardly from the circumference of the auxiliary tool 40. For the sake of clarity only two legs 90 are shown, but it will be clear that more legs can be arranged. Each leg 90 at its lower end is provided with a dog 91, such that the outer diameter defined by the dogs 91 at position 92 exceeds the outer diameter defined by the legs 90 at position 94, and also exceeds the inner diameter of the rim 79. Further, the inner diameter of the rim 79 is preferably larger or about equal to the outer diameter defined by the legs 90 at position 94, and the inner diameter of the outer sleeve 70 is smaller or approximately equal to the outer diameter defined by the dogs 91 at position 92. Further, the legs 90 are arranged so that they are inwardly elastically deformable as indicated by the arrows. The outer, lower edges 96 of the dogs 91 and the upper inner circumference 97 of the rim 79 are bevelled.

Normal operation of the drilling bit 1 according to FIGS. 1–3 will now be discussed. For drilling operation the closure element 25 is in its closing position, i.e. fully inserted and locked into the bit body 8. The overall shape of the drilling bit 1 is therefore that of a conventional tricone bit. The cooperating shapes of the base 29 and of the recess 62 allow full transmission of drilling torque from the drill string 3 via the bit body 8 to the closure element 25, without a relative motion of the closure element with respect to the bit body. The drilling performance of the drilling bit 1 is therefore not compromised as compared to a conventional drilling bit.

When it is desired to remove the closure element 25 from the closing position, the drilling operation is stopped. Then, the drill string 3 with the attached drilling bit 1 is pulled up sufficiently far from the bottom of the wellbore 2 in order that there is enough space in the borehole ahead of the drilling bit. The auxiliary tool 40 is lowered from a position inside the drill string 3 to enter the bit body 8. In the bit shank 15 the foremost longitudinal section 43 is deflected by the whipstock 48 in the direction of the offset bore 30, and enters the bore 30 at further lowering.

At further lowering the connection means 50 engages the upper end of 52 of the closure element 25. The dogs 91 slide into the upper rim 79 of the outer sleeve 70. The legs 90 are deformed inwardly so that the dogs can slide fully into the upper rim 79 until they engage the upper end 76 of the inner sleeve 75. By further pushing down, the inner sleeve 75 will be forced to slide down inside the outer sleeve 70, further compressing the spring 80. When the space between the upper end 76 of the inner sleeve 75 and the shoulder 78 has become large enough to let in the dogs 91, the legs 90 snap outwardly, thereby latching the auxiliary tool to the closure element.

At approximately the same relative position between inner and outer sleeves, where the legs snap outwardly, the recesses 87 register with the balls 85, thereby unlatching the closure element 25 from the bit body 8. When the closure element 25 has been disconnected from the bit body 8 and moved some distance in outward direction it is in an opening position, thereby allowing passage of the auxiliary tool 40 through the passageway 18. At further pushing down of the auxiliary tool 40 the closure element 25 is integrally pushed out of the bore 30 through the opening 60.

Since the bore 30 is arranged parallel with the axis 31 of the drilling bit 1, the closure element 25 will stay clear of the wellbore wall when moving longitudinally outwardly from the bit body 8 into the space 20 ahead of the drilling bit. It will be understood that the bore 30 can also be arranged at a small angle with the axis 31 so that the closure element moves slightly away from the wellbore wall when sliding out of the bore 30.

The tool can for example be lowered far enough for the measurement section 55 to enter the space 20 exterior of the drilling bit, so that measurements can be performed in the open hole.

When it is so desired, the closure element 25 can be returned to the closing position by retracting the auxiliary tool 40 until the locking balls 85 of the closure element latches again into the annular recess 86 of the bit body 8, where after the auxiliary tool can be disconnected from the closure element.

Figure 4:
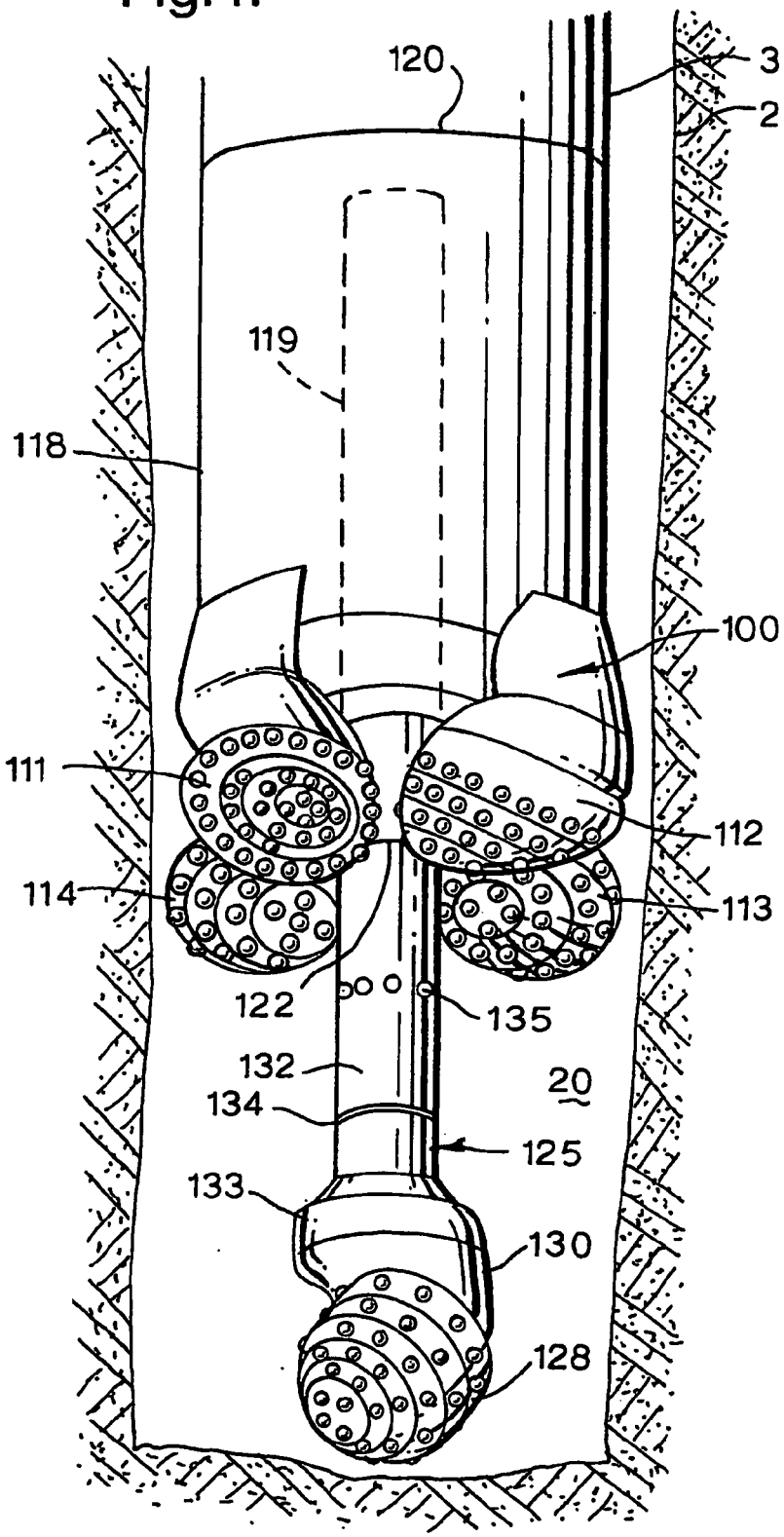
FIG. 4 shows schematically a second embodiment of a drilling bit according to the invention.

Reference is now made to FIG. 4, showing schematically a second embodiment of a drilling bit 100 according to the invention.

The drilling bit 100 is based on a coring bit, which in this example has chip-making elements in the form of roller cones 111,112,113,114 arranged around the circumference of the bit, and wherein a circular co-axial space is arranged to receive the core drilled out of the formation by the action of the roller cones. The roller cones are fixedly attached around the circumference of the bit body 118. The co-axial space has the form of a longitudinal through-bore (indicated in the perspective drawing by the dashed lines 119) of the bit body 118, running from the upper end 120 of the bit body to an opening 122 at the lower end. On the upper end 120 a drill string 3 is attached, and the through-bore is in fluid communication with the interior of the drill string 3, thereby providing a passageway between the interior of the drill string 3 and the exterior 20 of the bit body 118.

According to the invention there is further provided a closure element 125 of the passageway. The closure element 125 comprises a roller cone 128, which is mounted on a cone leg 130, and a cylindrical cone shank 132 is connected to the base 133 of the cone leg 130. The closure element 125 is shown in an opening position, disconnected from the bit body 118. The cone shank 132 can slide into the through-bore of the bit body 118 such that the roller cone 128 assumes a position in between the other roller cones, which is referred to as the closing position of the closure element with respect to the passageway. A sealing ring 134 is arranged around the cone shank 132.

A latching mechanism similar to that discussed with reference FIG. 3 is provided on the cone shank 132 and in the through-bore to allow locking of the cone shank (and therewith of the closure element) to the bit body 118. The locking balls of the latching mechanism in the cone shank 132 are indicated in the drawing with reference numeral 135.

Further, the base 133 and the bit body 118 around the opening 122 have co-operating contact surfaces of non-circular (e.g. oval) cross-section, in order to allow full transmission of drilling torque on the roller cone 128 when the closure element is in the closing position.

In order to release the closure element from the closure position and to move it into the extracted position as shown in FIG. 4, an auxiliary tool (not shown) can be used operating from inside the drill string. Since the closure element in this example is arranged co-axially with the drill bit, there is no need for a hinged auxiliary tool or for a guiding whipstock in the bit body 118. The lower end of the auxiliary tool and the upper end of the cone shank 132 are suitably provided with co-operating connecting means.

Normal operation of the drilling bit 100 is similar to that of that of the bit discussed with reference to FIGS. 1–3. With the closure element locked into the closing position, the drilling bit has the shape of a pentacone roller cone bit, and can be used to drill a wellbore interval. When the drilling operation has stopped, the closure element can be removed from the closing position by connecting the auxiliary tool to the cone shank 132, unlatching the cone shank from the bit body 118, and pushing the closure element out.

In a particular application the roller cone 128 can be used as a pilot drill, in order to drill a pilot borehole of smaller diameter at the bottom of the wellbore 2. To this end the auxiliary tool functions as a secondary drill string.

It will be understood that instead of the four roller cones 111,112,113,114 other chip-making elements could be used on the bit body, for example polycrystalline diamond compact (PDC) cutters. A conventional PDC coring bit could therefore be modified into a bit body for a drilling bit according to the invention.

A drilling bit according to the invention can also be based on other conventional bits, such as a reamer bit or a bicenter bit. For example, in a two-stage reamer bit comprising a pilot section and a reamer section, the pilot section could be replaced by a removable closure element similar to that discussed with reference numeral 125 in FIG. 4.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. A well drilling bit comprising:

a bit body attachable to a tubular drill string, which bit body is internally provided with a passageway other than a nozzle, which passageway provides fluid communication, when the drill string is attached to the bit body, between the interior of the drill string and the exterior of the bit body;

a closure element for selectively closing the passageway; and one or more chip-making elements, wherein the chip-making elements comprise one or more roller-cones, wherein the closure element is releasably connectable to the bit body, and outwardly movable from a closing position, in which the closure element is connected to the bit body, to an opening position, in which the closure element is disconnected from the bit body, wherein the closure element includes at least one of the roller-cones and a cone leg, and wherein the passageway comprises a section that is not co-axial with the central longitudinal axis.

2. The well drilling bit according to claim 1, wherein the well drilling bit with the closure element in the closing position has substantially the form of a bit selected from the group consisting of a roller-cone bit, a tricone roller-cone bit, a pentacone roller-cone bit, a reamer bit, and a bicenter bit.

3. The well drilling bit according to claim 1, wherein the well drilling bit without the closure element substantially has the form of a coring bit.

4. The well drilling bit according to claim 1, wherein the cone leg functions as a carrier element for the at least one roller cone.

5. The well drilling bit according to claim 1, wherein the closure element is provided with bit latching means for selectively latching the closure element to the bit body.

6. A well drilling bit comprising:

a bit body attachable to a tubular drill string, which bit body is internally provided with a passageway other than a nozzle, which passageway provides fluid communication, when the drill string is attached to the bit body, between the interior of the drill string and the exterior of the bit body;

a closure element for selectively closing the passageway; and one or more chip-making elements, wherein the chip-making elements comprise one or more roller-cones, wherein the closure element is releasably connectable to the bit body, and outwardly movable from a closing position, in which the closure element is connected to the bit body, to an opening position, in which the closure element is disconnected from the bit body, wherein the closure element includes at least one of the roller-cones, and wherein the passageway comprises a section that is not co-axial with the central longitudinal axis, wherein the closure element is arranged to stay clear of a wellbore wall formed during normal operation of the drilling bit when the closure element is moved from the closing position to the opening position.

7. A well drilling bit comprising:

a bit body attachable to a tubular drill string, which bit body is internally provided with a passageway other than a nozzle, which passageway provides fluid communication, when the drill string is attached to the bit body, between the interior of the drill string and the exterior of the bit body;

a closure element for selectively closing the passageway; and one or more chip-making elements, wherein the chip-making elements comprise one or more roller-cones, wherein the closure element is releasably connectable to the bit body, and outwardly movable from a closing position, in which the closure element is connected to the bit body, to an opening position, in which the closure element is disconnected from the bit body, wherein the closure element includes at least one of the roller-cones, and wherein the passageway comprises a section that is not co-axial with the central longitudinal axis, wherein the closure element forms a pilot drill bit.

8. A well drilling bit comprising:

a bit body attachabled to a tubular drill string, which bit body is internally provided with a passageway other than a nozzle, which passageway provides fluid communication between the interior of the drill string and the exterior of the bit body;

a closure element for selectively closing the passageway; and one or more chip-making elements, wherein the chip-making elements comprise one or more roller-cones, wherein the closure element is releasably connectable to the bit body, and outwardly movable from a closing position, in which the closure element is connected to the bit body, to an opening position, in which the closure element is disconnected from the bit body, wherein the closure element includes at least one of the roller-cones, and wherein the passageway comprises a section that is not co-axial with the central longitudinal axis, and wherein there is further provided an auxiliary tool comprising connecting means for selectively connecting the auxiliary tool to the closure element, and wherein the interior of the drill string and the passageway of the bit body are arranged to allow the auxiliary tool to pass from a position in the drill string to the closure element.

9. The well drilling bit according to claim 8, wherein the auxiliary tool comprises two or more longitudinal sections which are hingedly connected.

10. The well drilling bit according to claim 8, wherein the passageway of the bit body is arranged to allow the auxiliary tool to pass to the exterior of the bit body, when the closure element has been removed from the bit body.

11. The well drilling bit according to claim 8, wherein the connecting means of the auxiliary tool comprises a tool latching means for latching the auxiliary tool to the closure element.

12. The well drilling bit according to claim 11, wherein the closure element is provided with bit latching means for selectively latching the closure element to the bit body.

13. The well drilling bit according to claim 12, wherein the tool latching means and the bit latching means are arranged so as to unlatch the closure element from the bit body upon latching of the auxiliary tool to the closure element.

14. A well drilling bit comprising:

a bit body attachable to a tubular drill string, which bit body is internally provided with a passageway other than a nozzle, which passageway provides fluid communication, when the drill string is attached to the bit body, between the interior of the drill string and the exterior of the bit body;

a closure element for selectively closing the passageway; and one or more chip-making elements, wherein the chip-making elements comprise one or more roller-cones, wherein the closure element is releasably connectable to the bit body, and outwardly movable from a closing position, in which the closure element is connected to the bit body, to an opening position, in which the closure element is disconnected from the bit body, wherein the closure element includes at least one of the roller-cones, and wherein the passageway comprises a section that is not co-axial with the central longitudinal axis, wherein the closure element further includes a carrier element for each included roller-cone.

15. A well drilling bit comprising:

a bit body attachable to a tubular drill string, which bit body is internally provided with a passageway other than a nozzle, which passageway provides fluid communication, when the drill string is attached to the bit body, between the interior of the drill string and the exterior of the bit body;

a closure element for selectively closing the passageway; and one or more chip-making elements, wherein the chip-making elements comprise one or more roller-cones, wherein the closure element is releasably connectable to the bit body during an operation when the bit body is located in a wellbore, whereby the closure element is outwardly movable from a closing position, in which the closure element is connected to the bit body, to an opening position, in which the closure element is disconnected from the bit body, wherein the closure element includes at least one of the roller-cones, and wherein the passageway comprises a section that is not co-axial with the central longitudinal axis.

16. The well drilling bit according to claim 15, wherein the closure element includes a cone leg.

17. Method of drilling a wellbore, comprising providing a well drilling bit comprising:

a bit body attachable to a tubular drill string, which bit body is internally provided with a passageway other than a nozzle, which passageway comprises a section that is not co-axial with the central longitudinal axis, which passageway provides fluid communication, when the drill string is attached to the bit body, between the interior of the drill string and the exterior of the bit body;

one or more chip-making elements, the chip-making elements comprising one or more roller-cones;

a closure element for selectively closing the passageway, the closure element including at least one of the roller-cones;

lowering the well drilling bit to a bottom of a wellbore;

applying drilling torque to the well drilling bit with the closure element in a closing position;

pulling the well drilling bit up sufficiently far from the bottom of the wellbore in order that there is enough space in the wellbore ahead of the well drilling bit for bringing the closure element in an opening position;

moving the closure element outwardly into the wellbore, from the closing position, in which the closure element is connected to the bit body, to the opening position, in which the closure element is disconnected from the bit body.

18. The method of claim 17, further comprising returning the closure element to the closing position while the well drilling bit is located in the wellbore.

19. The method of claim 18, wherein moving the closure element outwardly into the wellbore to the opening position comprises lowering an auxiliary tool from a position inside the drill string to enter the bit body, and returning the closure element to the closing position comprises retracting the auxiliary tool.

20. The method of claim 17, wherein moving the closure element outwardly into the wellbore to the opening position comprises lowering an auxiliary tool from a position inside the drill string to enter the bit body.

21. The method of claim 17, wherein moving the closure element outwardly into the wellbore comprises allowing a measurement section to enter the space in the wellbore exterior of the drilling bit.

* * * * *